US006315676B1

(12) United States Patent
Sandlin

(10) Patent No.: US 6,315,676 B1
(45) Date of Patent: Nov. 13, 2001

(54) GOLF BALL TEEING DEVICE

(76) Inventor: David Alden Sandlin, 4895 N. Thorne, Fresno, CA (US) 93705

( * ) Notice: Subject to any disclaimer, the term of this patent is extended or adjusted under 35 U.S.C. 154(b) by 0 days.

(21) Appl. No.: 09/418,534

(22) Filed: Oct. 14, 1999

(51) Int. Cl.[7] ..... A63B 57/00
(52) U.S. Cl. ..... 473/137
(58) Field of Search ..... 473/134, 135, 473/136, 137, 132, 133

(56) References Cited

U.S. PATENT DOCUMENTS

| | | | | |
|---|---|---|---|---|
| 3,003,770 | * | 10/1961 | Jones | 473/134 |
| 4,132,214 | | 1/1979 | Schnurr et al. . | |
| 4,265,453 | | 5/1981 | Loof . | |
| 4,360,204 | | 11/1982 | Karr . | |
| 4,391,446 | | 7/1983 | Eberle . | |
| 4,541,632 | | 9/1985 | Tillery . | |
| 4,602,789 | | 7/1986 | Chung . | |
| 4,676,397 | | 6/1987 | Hoffmeister . | |
| 4,732,391 | | 3/1988 | Karr . | |
| 4,741,537 | | 5/1988 | Adam . | |
| 4,796,893 | * | 1/1989 | Choi | 473/137 |
| 4,817,955 | | 4/1989 | Hickson et al. . | |
| 4,892,318 | * | 1/1990 | Jennings | 473/137 |
| 4,981,299 | | 1/1991 | Petrillo . | |
| 5,022,657 | * | 6/1991 | Bussiere et al. | 473/137 |
| 5,326,107 | | 7/1994 | Park . | |
| 5,464,223 | * | 11/1995 | Dermott | 473/134 |
| 5,624,325 | * | 4/1997 | Smith | 473/137 |
| 5,743,804 | | 4/1998 | Bacon | 473/132 |
| 5,820,475 | | 10/1998 | Luna | 473/137 |
| 5,839,607 | | 11/1998 | Swanson . | |
| 5,885,174 | | 3/1999 | Barnes | 473/386 |

OTHER PUBLICATIONS

"The Quick Tee," Dora–John Co., 1998.

* cited by examiner

*Primary Examiner*—Steven Wong
(74) *Attorney, Agent, or Firm*—Carol D. Titus; James J. Leary

(57) ABSTRACT

A golf ball teeing device having a hopper containing a plurality of golf balls. A ball placing arm extends from one side of the hopper and rotates between a generally upright, rest position and a generally horizontal, ball-dispensing position. The ball dispensing arm rotates about a rod, which forms a pivot point. The rod extends through the hopper. Attached to the rod and within the hopper is a plate. As the ball dispensing arm rotates, the rod and plate are rotated, thereby agitating the balls within the hopper. A spring is used to bias the ball dispensing arm towards the upright position. A ball stopping arm is biased towards a position which blocks the outlet opening of the hopper, thereby inhibiting the loss of balls escaping the hopper. A locking arm may be used to hold the ball stopping arm in front of the outlet opening of the hopper, thereby stopping operation of the golf ball teeing device to allow transport, etc. without the loss of the balls contained within the hopper.

22 Claims, 7 Drawing Sheets

GOLF BALL TEEING DEVICE

FIELD OF THE INVENTION

The present invention relates to a device for placing a golf ball. More particularly, it relates to a device for repeatedly placing one of a hopper full of golf balls in a chosen location, such as on a golf tee.

BACKGROUND OF THE INVENTION

When practicing golf at the driving range, setting each ball on the tee is a necessary, if uninviting task. Therefore, over the years many devices have been designed to aid in accomplishing this task. There are devices having an assortment of feeding mechanisms. Some of the devices are towers with a long spiral track. Others are hoppers that lead into a track that zigzags down prior to feeding the balls. The long track designs try to feed most if not all of the balls into the track, thereby reducing the problems of the balls jamming on the way to the outlet. However, these long track designs are generally expensive to manufacture due to the many or long sections of track. Frequently these devices also require that the user feed each ball into the track manually.

The prior art also has a plurality of different styles of levers and arms that are actuated to place the golf balls. Frequently these devices are expensive to manufacture due to the number of parts required for the device to properly place the ball.

Another family of golf ball feeders has the ball roll into place. This style of feeder is prone to failure since the ball is moving in a generally horizontal path when the ball reaches the desired location. In this situation, there is a high probability that the ball will continue to roll and move past the chosen location.

Examples of prior art devices are found in U.S. Pat. No. 4132214 to Schnurr et al., U.S. Pat. No. 4265453 to Loof, U.S. Pat. No. 4360204 to Karr, U.S. Pat. No. 4391446 to Eberle, U.S. Pat. No. 4541632 to Tillery, U.S. Pat. No. 4602789 to Chung, U.S. Pat. No. 4676397 to Hoffmeister, U.S. Pat. No. 4732391 to Karr, U.S. Pat. No. 4741537 to Adam, U.S. Pat. No. 4817955 to Hickson et al., U.S. Pat. No. 4981299 to Petrillo, U.S. Pat. No. 5326107 to Park, U.S. Pat. No. 5820475 to Luna, U.S. Pat. No. 5743804 to Bacon, U.S. Pat. No. 5839607 to Swanson and U.S. Pat. No. 5885174 to Barnes.

However, all of the designs are prone to jamming or bridging which is when the configuration and friction of the balls allows the balls to form a bridge over the outlet or exit hole from the hopper. A user must then open the lid and agitate the balls in order to continue feeding balls.

SUMMARY OF THE INVENTION

In keeping with the forgoing discussion, the present invention takes the form of a golf ball teeing device having a hopper for containing a plurality of golf balls. A ball placing arm extends from one side of the hopper and rotates between a generally upright, rest position and a generally horizontal, ball-dispensing position. The ball dispensing arm rotates about a rod, which forms a pivot point. The rod extends through the hopper. Attached to the rod and within the hopper is a plate. As the ball dispensing arm rotates, the rod and plate are rotated, thereby agitating the balls within the hopper. A spring is used to bias the ball dispensing arn towards the upright position. A ball stopping arm is biased towards a position which blocks the outlet opening of the hopper, thereby inhibiting the loss of balls escaping the hopper. A locking arm may be used to hold the ball stopping arm in front of the outlet opening of the hopper, thereby stopping operation of the golf ball teeing device to allow transport, etc. without the loss of the balls contained within the hopper.

DETAILED DESCRIPTION

Figure 1:
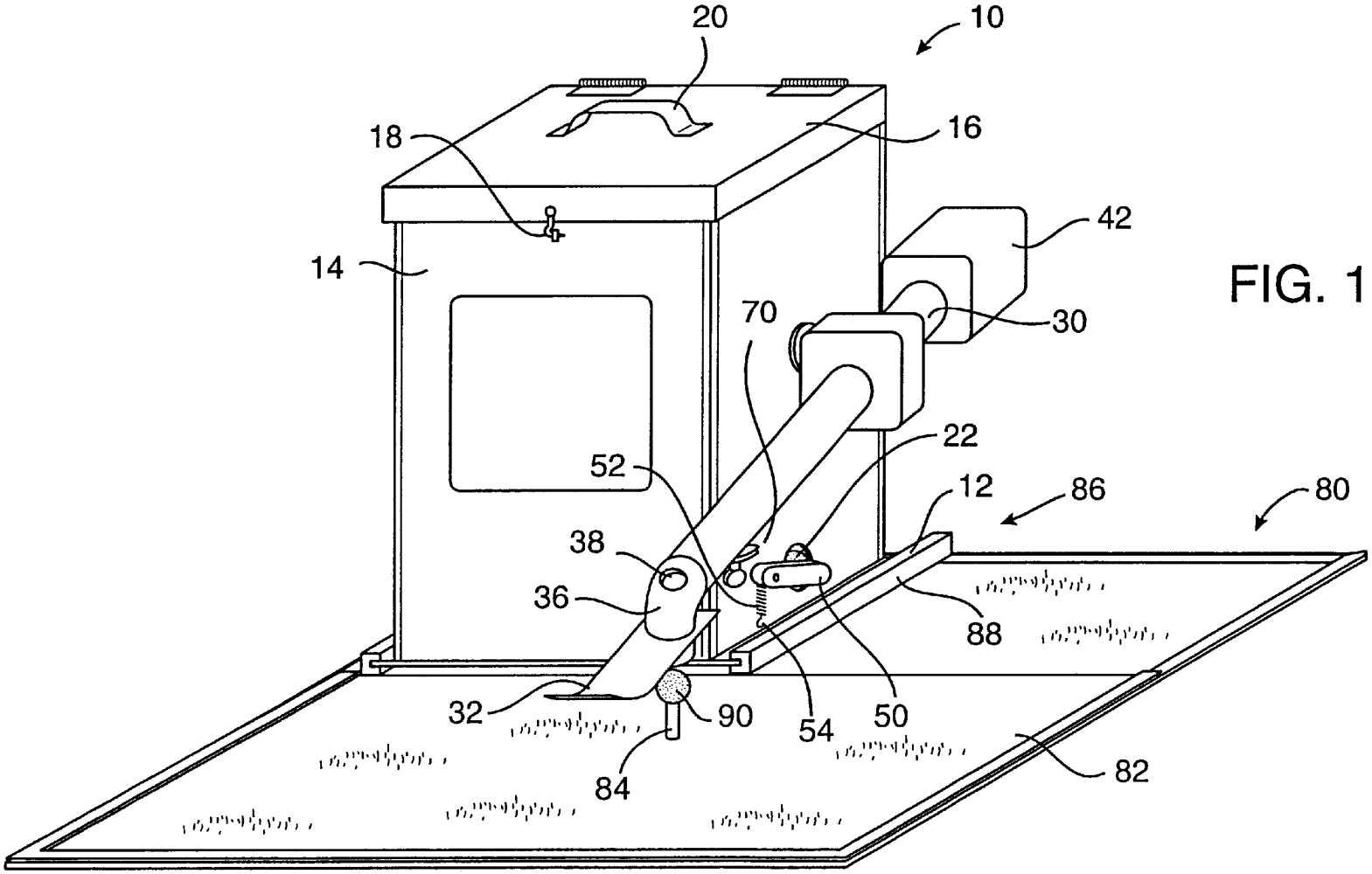
FIG. 1 is a perspective view of the golf ball teeing device.
Figure 2:
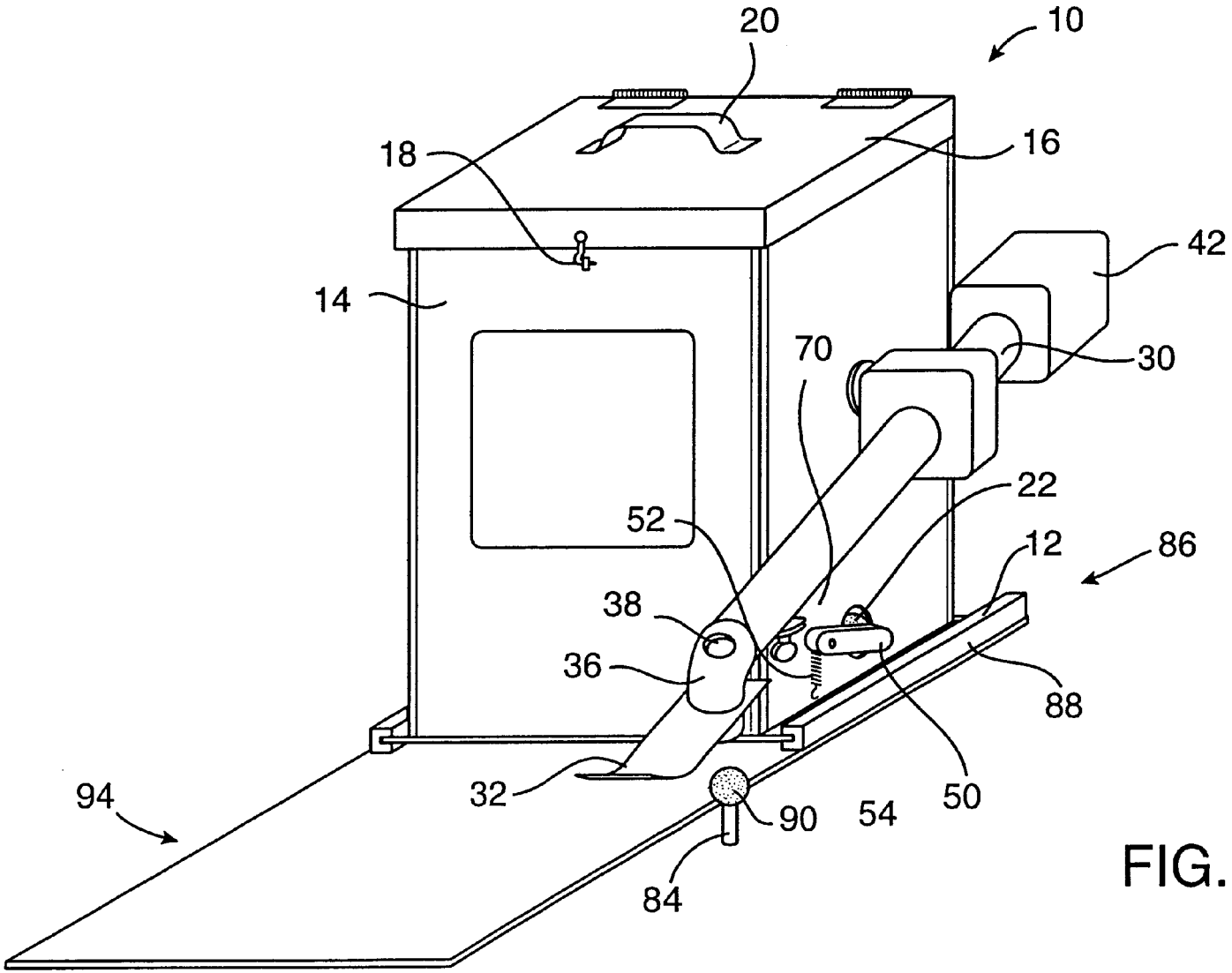
FIG. 2 is a perspective view of the golf ball teeing device with an alternate mat design.

FIG. 1 is a perspective view of the golf ball teeing device 10 on a teeing mat 80. The teeing mat 80 has simulated turf 82, a tee 84 and an interlock 86 to hold the golf ball teeing device 10 in place. In the embodiment shown, the interlock 86 takes the form of a pair of slots 88 into which depending legs 12 on the golf ball teeing device 10 are located. The location of the tee 84 on the mat 80 corresponds to the location at which the golf ball teeing device 10 will place the golf ball 90, thereby allowing the user to set up the device 10 without needing to align the golf ball teeing device 10 with the tee 84 for each new driving session. During transport and for storage, the golf ball teeing device 10 may be removed from the mat 80 by sliding the depending legs 12 out of the slots 88. The mat 80 is hinged along the center and may be folded to be more compact for storage. An alternate version of the teeing mat 94 is shown in FIG. 2. This version has a single panel having slots 88 to interlock with the golf ball teeing device 10. The alternate mat 94 is designed to slide beneath the simulated turf at the driving range. The golf ball teeing device 10 is then aligned with a tee. In cases where the teeing device 10 is placed above the turf, simulated turf may also be added to this version of the mat 94. The frame and base for the mats 80, 94 may be made of any durable material such as wood, metal, plastic, etc.

The golf ball teeing device 10 is formed of a hopper 14 for holding and feeding a plurality of golf balls 90 and a ball placing arm 30. The hopper 14 has a lid 16 for holding the balls 90 within the hopper 14 cavity. A latch 18 may be used to prevent the lid 16 from accidentally opening during use or transport. The latch 18 may be necessary in cases where a handle 20 is added to the top of the lid 16, as shown in FIG. 1. The latch 18 shown is a hook attached to the lid 16 which engages an eye located on the body of the hopper 14, however, any other suitable latch 18 and configuration may be used.

Figure 3:
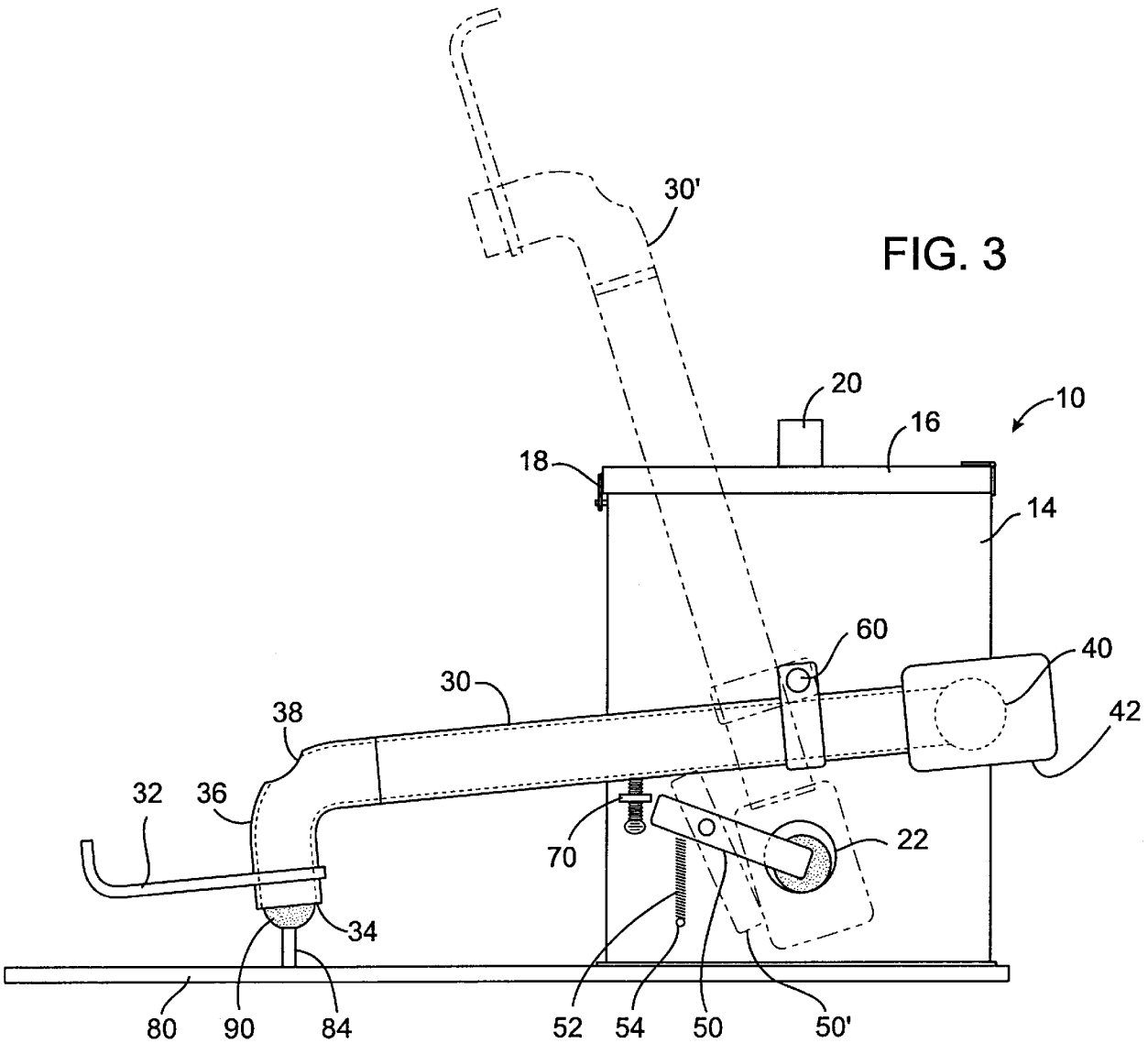
FIG. 3 is a right side view of the golf ball teeing device.

FIG. 3 is a right side view of the golf ball teeing device 10 showing ball placing arm 30 in the lowered position. The raised position 30' is shown in phantom lines. When a user want to place another ball 90 on the tee 84, he or she uses a foot or golf club to engage a club engaging projection 32 on the ball placing arm 30 to rotate the ball placing arm 30 down. Although the club engaging projection 32 may be configured in any convenient shape, the dub engagement projection 32 shown is a flat generally L-shaped member extending from the end of the ball placing arm 30.

When in the upright position 30', the inlet opening 40 of the ball placing arm 30 is aligned with the outlet opening 22 of the golf ball hopper 14, thereby allowing a ball 90 leaving the outlet opening 22 of the hopper 14 to enter the ball placing arm 30 through the inlet opening 40. When the ball placing arm 30 is rotated past horizontal, the ball 90 inside rolls down inside the arm 30 and out through an outlet opening 34. The embodiment shown has an approximately 90 degree bend 36 in the arm 30, thereby dropping the ball 90 almost vertically onto the tee 84. The vertical approach to the tee 84 decreases the likelihood of the ball 90 falling off of the tee 84. Depending on the needs of the user, the angle of the bend 36 could be increased, decreased or omitted. For convenience when aligning the golf ball teeing device 10 with a tee 84, the ball placing arm 30 has a viewing hole 38 smaller than a golf ball 90 and extending therethrough. The viewing hole 38 is concentrically aligned with the outlet opening 34 to allow the user to see out the outlet opening 34 from the top of the lowered arm 30, thereby allowing the user to quickly and easily align the outlet opening 34 with the tee 84.

When the ball placing arm 30 is moved from the vertical position 30' towards the horizontal position 30 a ball stopping projection 50 is rotated in front of the outlet opening 22 of the hopper 14 to obstruct other balls 90 from exiting the hopper 14. The ball stopping projection 50 is biased to rest in front of the outlet opening 22 of the hopper 14 by a spring 52 attached to a post 54 on the exterior of the golf ball teeing device 10. When the ball placing arm 30 returns to its generally vertical, rest position 30', the base 42 of the arm 30 pushes the ball stopping projection 50 out from in front of the outlet opening 22 of the hopper 14 to a retracted position 50', thereby realigning the inlet opening 40 of the ball placing arm 30 with the outlet opening 22 of the hopper 14. A rod 60 forms the pivot point of the ball placing arm 30 and is located part way along and offset from the longitudinal axis of the arm 30 and is generally perpendicular thereto. If preferred, the pivot point may be moved closer in line with the axis of the ball placing arm 30 by adjusting the configuration of the other related mechanisms.

A teeing height adjustment 70 may be placed to selectively engage the ball placing arm 30 to adjust the maximum rotation of the ball placing arm 30, and thereby the height at which the golf ball 90 is deposited. In the embodiment shown, an angle bracket with a thumbscrew is used. Depending on the height at which the user places their tee, the thumbscrew may be adjusted by rotation to extend farther above the bracket for a higher tee height and less above the tee for a lower tee height. Other adjustable projections, such as a peg with a plurality of holes, a sliding member in a track, etc. may also be used.

Figure 4:
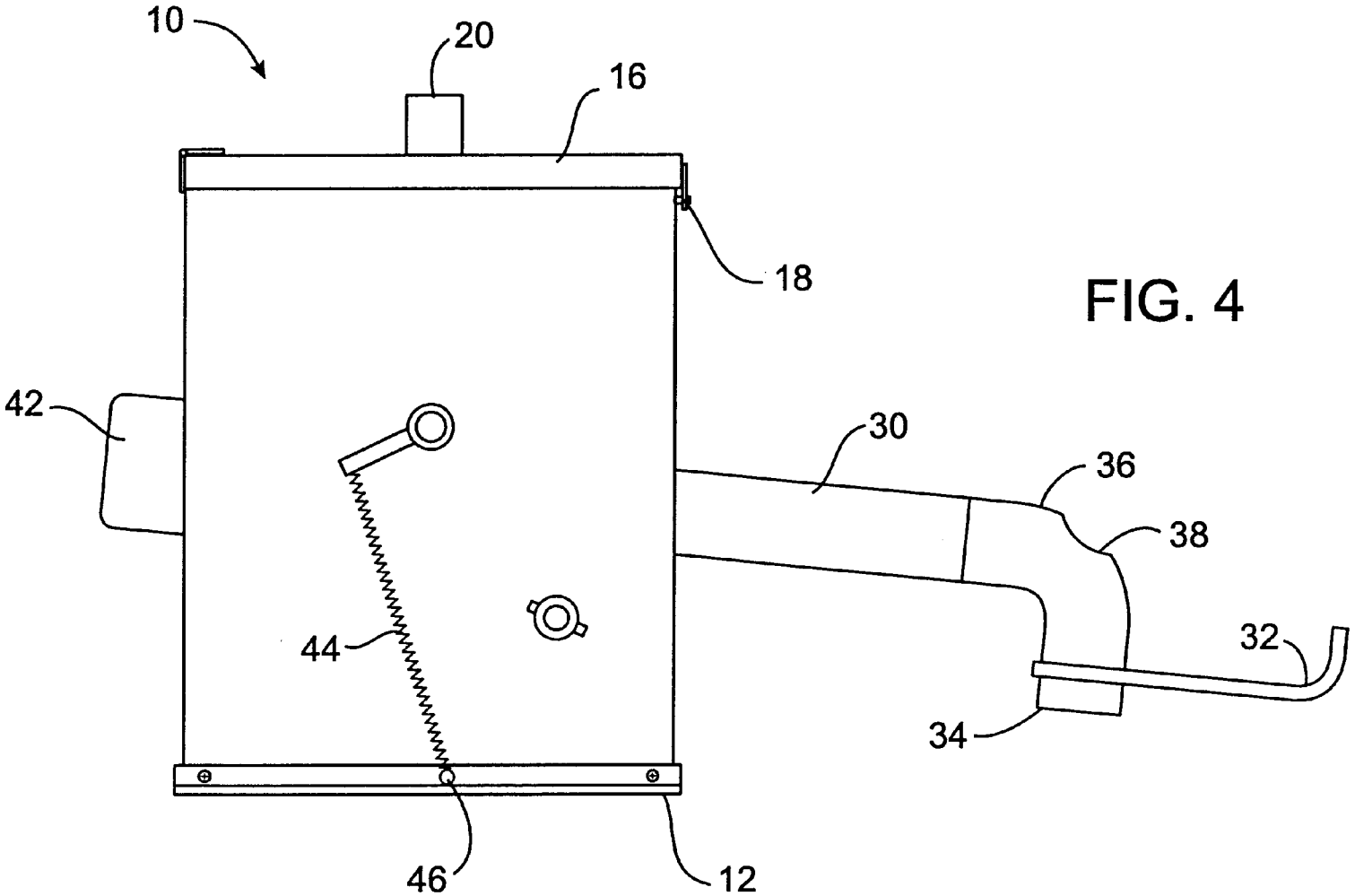
FIG. 4 is a left side view of the golf ball teeing device.

FIG. 4 is a left side view of the golf ball teeing device 10 showing the spring 44 used to bias the ball placing arm 30 in the upright position 30'. The spring 44 connects to the opposite end of the rod 60 around which the ball placing arm 30 rotates and to a post or projection 46 on the housing of the hopper 14.

Figure 6:
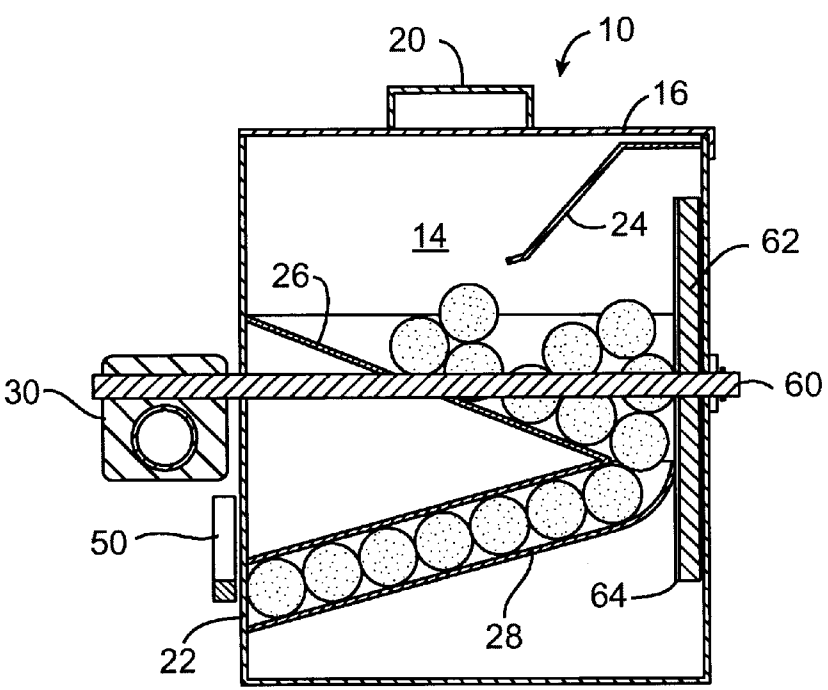
FIG. 6 is a cross-sectional view of the golf ball teeing device.
Figure 5:
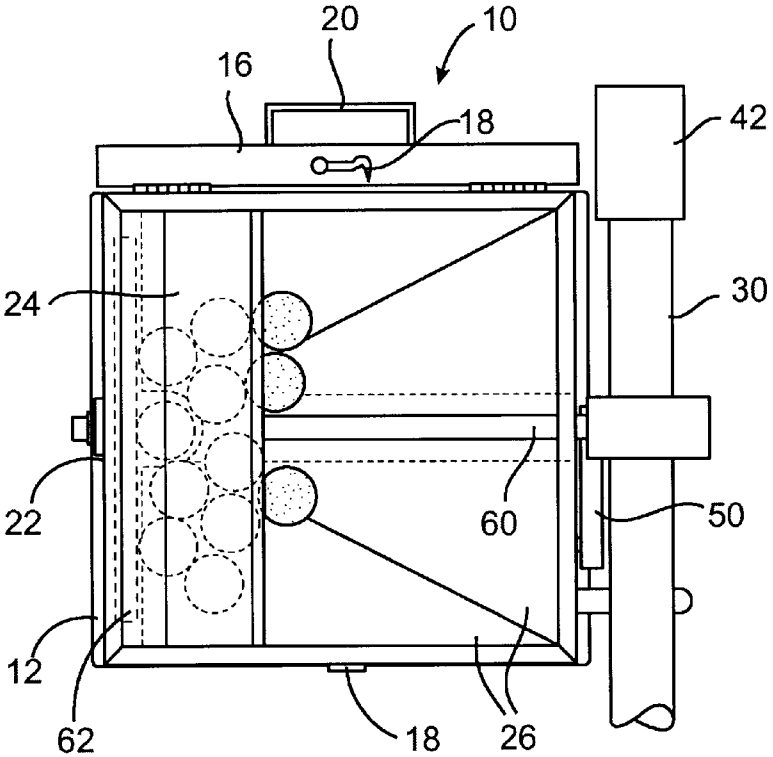
FIG. 5 is a top view of the golf ball teeing device with the lid open.
Figure 7:
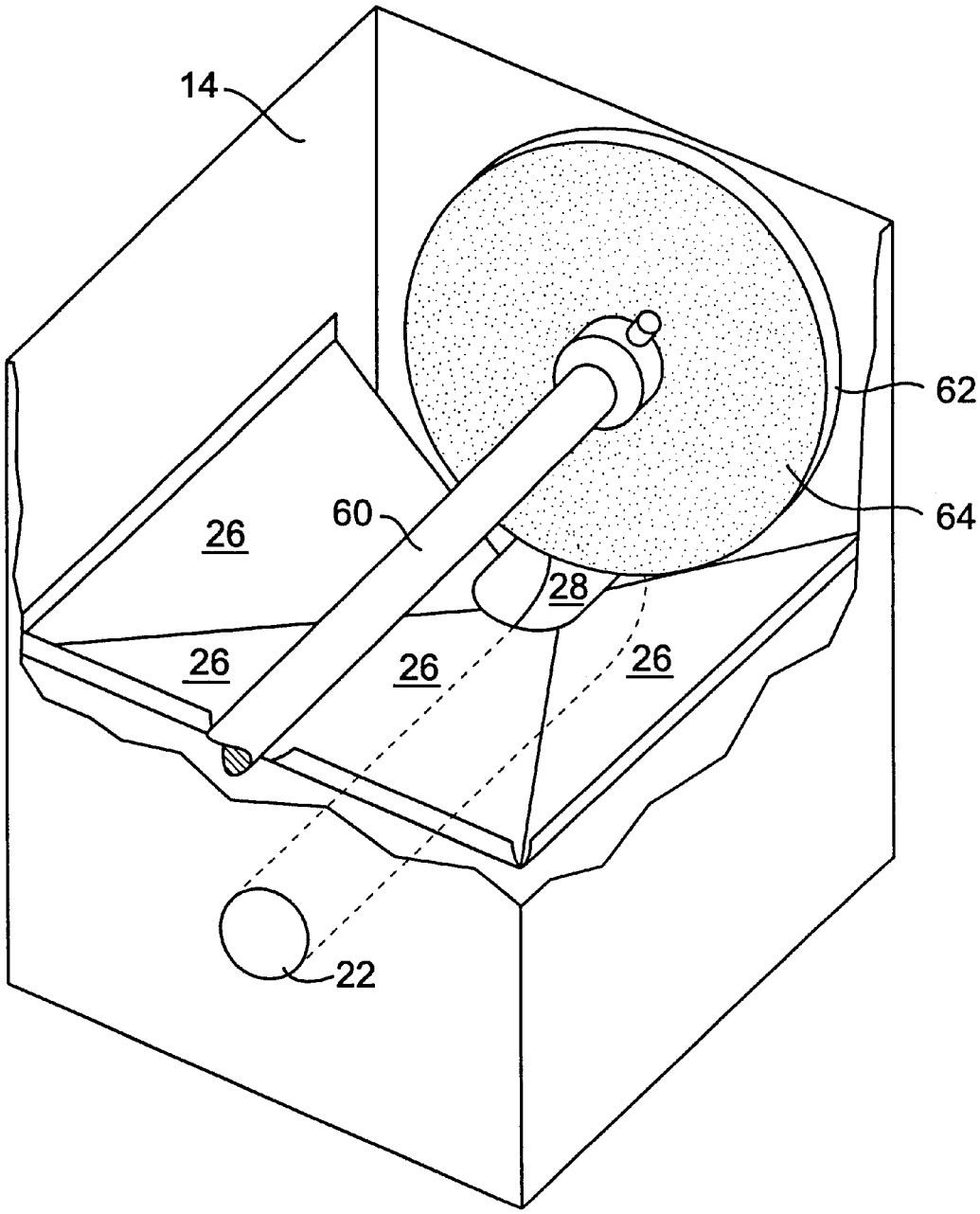
FIG. 7 is an internal perspective view of the golf ball teeing device.

FIG. 5 is a top view of the golf ball teeing device 10 with the lid 16 of the hopper 14 open. FIG. 6 is a cross-sectional view and FIG. 7 is an internal perspective view of the ball teeing device 10. Inside the hopper 14 are sloped walls extending down to form a funnel 26 which feeds the balls 90 toward a channel 28 leading to the outlet opening 22 of the hopper 14. The rod 60, around which the ball placing arm 30 rotates, extends through the hopper 14 and attaches the ball placing arm 30 with the spring 44 biasing mechanism. Within the hopper 14 a plate 62 is attached to the rod 60. When the ball placing arm 30 is moved between the generally vertical position 30' and the generally horizontal position 30, the rod 60 and plate 62 rotate, thereby agitating the balls 90 located within the hopper 14. In the embodiment shown, the plate 62 is generally circular although other shapes may be used as long as the shape can rotate within the hopper 14. To provide additional traction on the balls 90, the surface of the plate 62 may be roughened or a rough material such as sand paper, rubber or other textured or high friction material may be used to create a friction surface 64, thereby increasing the friction between the balls 90 and the plate 62. Agitation of the balls 90 prevents the balls 90 from jamming or bridging, thereby assuring a constant flow of golf balls 90 from the golf ball teeing device 10 as long as there are balls 90 in the hopper 14. A flange 24 extends down into the hopper 14. The flange 24 angles downward and limits the number of golf balls 90 engaging the plate 62. Limiting the number of golf balls 90 engaging the plate 62 reduces the chances of the balls 90 unnecessarily impeding motion of the plate 62, thereby allowing easy motion of ball placing arm 30.

Figure 8:
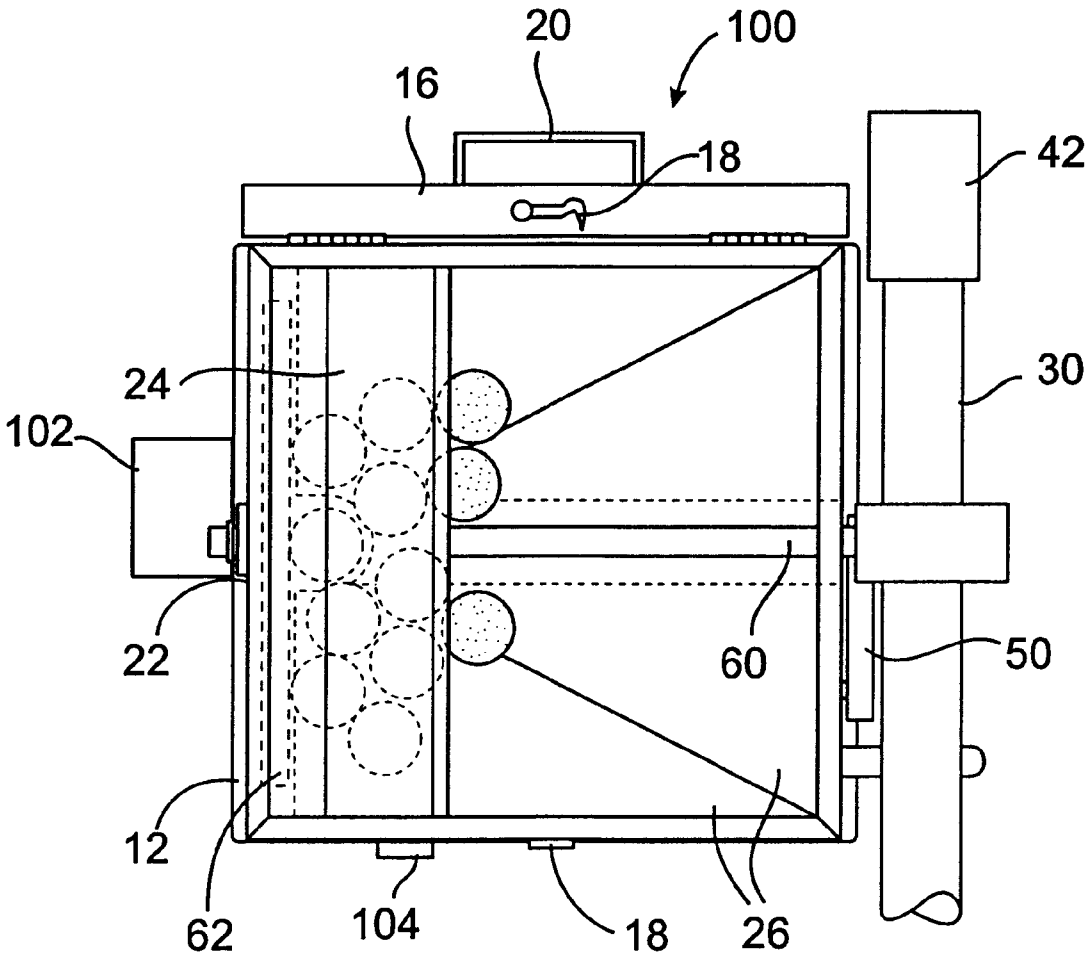
FIG. 8 is a top view of an alternate version of the golf ball teeing device with the lid open.

FIG. 8 is a top view of an alternate version of the golf ball teeing device 100 using a motor 102 to drive the ball placing arm 30. When a user wants to place a ball 90 on a tee 84, the user presses a button 104 by hand, with a club, foot, etc., and the ball placing arm 30 rotates from the vertical position 30' to the generally horizontal position 30. The ball placing arm 30 stops and waits for a selected time period, such as two seconds, to allow the ball 90 to roll down the ball placing arm 30 and out through the outlet opening 34 on to the tee 84. The ball placing arm 30 then returns to the vertical position 30'. When the user wants an additional golf ball 90, the process is repeated. The motor 102 may be any standard configuration running on AC or DC power. For example, a 12 volt battery operated model may be used.

Many features have been listed with particular configurations, options, and embodiments. Any one or more of the features described may be added to or combined with features or embodiments described or other standard devices to create alternate combinations and embodiments.

Although the examples given include many specificities, they are intended as illustrative of only one possible embodiment of the invention. Other embodiments and modifications will, no doubt, occur to those skilled in the art. For example, the location of the arm may be reversed to place the ball placing arm on the opposite side of the hopper thereby creating a golf ball teeing device for left handed golfers. Thus, the examples given should only be interpreted as illustrations of some of the preferred embodiments of the invention, and the full scope of the invention should be determined by the appended claims and their legal equivalents.

I claim:

1. A golf ball teeing device for placing a golf ball on a tee, comprising:

a hopper having an outlet opening, a ball placing arm having an inlet opening, an outlet opening, a first position and a second position, wherein in said first position, said inlet opening is generally aligned with said outlet opening of said hopper, a rod attached to said ball placing arm, a funnel located within said hopper, and a plate attached to said rod and located within said hopper, at least a portion of said plate forming at least a majority of a wall of said funnel, wherein when said ball placing arm is moved between said first position and said second position, said rod and said plate are rotated.

2. The golf ball teeing device of claim 1 wherein said ball placing arm is biased towards said first position.

3. The golf ball teeing device of claim 1 further comprising a spring attached to said ball placing arm and said hopper, said spring biasing said ball placing arm towards said first position.

4. The golf ball teeing device of claim 1 further comprising a ball stopping projection rotatably attached to said hopper.

5. A golf ball teeing device for placing a golf ball on a tee, comprising:

a hopper having an outlet opening, a ball placing arm having an inlet opening, an outlet opening, a first position and a second position, wherein in said first position, said inlet opening is generally aligned with said outlet opening of said hopper, a rod attached to said ball placing arm, a plate attached to said rod and located within said hopper, a ball stopping projection rotatably attached to said hopper, wherein when said ball placing arm is moved between said first position and said second position, said rod and said plate are rotated, and wherein said ball stopping projection is biased toward a first position wherein said ball stopping projection covers at least a portion of said outlet opening of said hopper.

6. A golf ball teeing device for placing a golf ball on a tee, comprising:

a hopper having an outlet opening, a ball placing arm having an inlet opening, an outlet opening, a first position and a second position, wherein in said first position, said inlet opening is generally aligned with said outlet opening of said hopper, a rod attached to said ball placing arm, a plate attached to said rod and located within said hopper, a ball stopping projection rotatably attached to said hopper, and a spring attached to said ball stopping projection and to said hopper, said spring biasing said ball stopping projection towards a first position wherein said ball stopping projection covers at least a portion of said outlet opening, wherein when said ball placing arm is moved between said first position and said second position, said rod and said plate are rotated.

7. The golf ball teeing device of claim 1 wherein said plate is round.

8. The golf ball teeing device of claim 1 wherein said plate has a friction surface.

9. The golf ball teeing device of claim 1 wherein said ball placing arm has an opening extending therethrough, said opening located directly above said outlet of said ball placing arm when said ball placing arm is in said second position.

10. The golf ball teeing device of claim 1 further comprising a teeing height adjustment extending from said hopper.

11. The golf ball teeing device of claim 10 wherein said teeing height adjustment includes a thumbscrew and a bracket.

12. A golf ball teeing device for placing a golf ball on a tee, comprising:

a hopper having an outlet opening, a funnel located within said hopper and leading to said outlet opening, a ball placing arm having an inlet opening, an outlet opening, a first position and a second position, wherein in said first position, said inlet opening is generally aligned with said outlet opening of said hopper, said ball placing arm being biased towards said first position, a rod attached to said ball placing arm and extending through the hopper across the width thereof, a plate attached to said rod, at least a portion of said plate forming at least a portion of said funnel, and a ball stopping projection rotatably attached to said hopper, wherein when said ball placing arm is moved between said first position and said second position, said rod and said plate are rotated.

13. The golf ball teeing device of claim 12 further comprising a spring attached to said ball placing arm and said hopper, said spring biasing said ball placing arm towards said first position.

14. A golf ball teeing device for placing a golf ball on a tee, comprising:

a hopper having an outlet opening, a funnel located within said hopper and leading to said outlet opening, a ball placing arm having an inlet opening, an outlet opening, a first position and a second position, wherein in said first position, said inlet opening is generally aligned with said outlet opening of said hopper, said ball placing arm being biased towards said first position, a rod attached to said ball placing arm, a generally round plate attached to said rod, at least a portion of said plate forming at least a portion of said funnel, a ball stopping projection rotatable attached to said hopper, and a spring attached to said ball stopping projection and to said hopper, said spring biasing said ball stopping projection towards a first position wherein said ball stopping projection covers at least a portion of said outlet opening, wherein when said ball placing arm is moved between said first position and said second position, said rod and said plate are rotated.

15. The golf ball teeing device of claim 12 wherein said plate has a friction surface.

16. The golf ball teeing device of claim 12 wherein said ball placing arm has an opening extending therethrough, said opening being located directly above said outlet of said ball placing arm when said arm is in said second position.

17. The golf ball teeing device of claim 12 further comprising a bracket extending from said hopper and a threaded member extending through a portion of said bracket whereby a user may rotate said threaded member within said bracket to adjust the location of said second position.

18. In combination:

a golf ball teeing device, comprising:

a hopper having a base and an outlet opening, a ball placing arm having an inlet opening, an outlet opening, a first position and a second position, wherein in said first position, said inlet opening is generally aligned with said outlet opening of said hopper, a rod attached to said ball placing arm, a funnel located within said hopper, a plate attached to said rod and located within said hopper, at least a portion of said plate forming at least a majority of a wall of said funnel, a pair of projections extending outward from said base of said hopper, wherein when said ball placing arm is moved between said first position and said second position, said rod and said plate are rotated, and a mat having a pair of slots configured to receive said pair of projections on said hopper.

19. The combination of claim 18 wherein said mat further comprises a tee.

20. The combination of claim 18 further comprising a plurality of golf balls located within said hopper and a tee located on said mat configured such that when one of said golf balls passes out of said outlet opening of said ball placing arm said golf ball is placed on said tee.

21. The golf ball teeing device of claim 1 wherein said rod extends through the hopper across the width thereof.

22. The golf ball teeing device of claim 12 further comprising a funnel located within said hopper, said rod located proximate a top edge of said funnel.

* * * * *